United States Patent [19]

Klompenburg

[11] Patent Number: 4,682,455

[45] Date of Patent: Jul. 28, 1987

[54] SLIDING WINDOW CONSTRUCTION

[75] Inventor: Marlo V. Klompenburg, Pella, Iowa

[73] Assignee: Rolscreen Company, Pella, Iowa

[21] Appl. No.: 661,380

[22] Filed: Oct. 16, 1984

[51] Int. Cl.[4] ..... E05D 15/20

[52] U.S. Cl. ..... 52/207; 49/177; 49/181

[58] Field of Search ..... 52/207, 204; 49/152, 49/177, 178, 181, 425, 257; 292/241, DIG. 72

[56] References Cited

U.S. PATENT DOCUMENTS

| | | | |
|---|---|---|---|
| 2,126,177 | 8/1938 | Dennis | 49/181 X |
| 2,767,008 | 10/1956 | Oswald | 202/241 |
| 2,890,501 | 6/1959 | Polson et al. | 49/177 |
| 3,041,680 | 7/1962 | Gurnuale | 49/177 X |
| 3,775,905 | 12/1973 | Frank | 49/176 X |
| 3,890,741 | 6/1975 | Johnson et al. | 49/177 X |
| 4,324,072 | 4/1982 | Sterner, Jr. | 49/181 X |

FOREIGN PATENT DOCUMENTS

| | | | |
|---|---|---|---|
| 1123185 | 9/1956 | France | 49/152 |

*Primary Examiner*—Carl D. Friedman
*Assistant Examiner*—Richard Chilcot
*Attorney, Agent, or Firm*—Zarley, McKee, Thomte, Voorhees & Sease

[57] ABSTRACT

An insulated sliding window assembly includes a compression seal between a mobile sash and the window frame. A locking mechanism cams the mobile sash to move both parallel to and transverse to the plane of the window frame, causing the sash to compress the seal and to be positively locked to the window frame. The moveable sash of the invention includes rollers which roll on guides. The sliding window assembly also includes mechanisms for releasing and pivoting the exterior moveable sash to a maintenance position.

41 Claims, 19 Drawing Figures

SLIDING WINDOW CONSTRUCTION

BACKGROUND OF THE INVENTION

This invention relates to sliding window assemblies. Common sliding windows include either a fixed sash and a movable sash side-by-side, or a pair of movable sashes also side-by-side. Without regard to type, the common sliding window has a negative reputation for being poor in thermal performance, difficult to open and close, most difficult to clean, and for being a security risk. The windows tend to leak frigid winter air, become icy, and in even good weather, resist all but aggressive manual movement. The sashes of some such windows can only be cleaned by complete removal of the sashes from the window frame. Most such windows include only locks between the two sashes.

SUMMARY OF THE INVENTION

An object of the inventor in making this invention was to provide a sliding window featuring excellent thermal performance, ease of operation, each of access to all glass surfaces for cleaning, and security.

The invention proceeds from a basic departure in the manner in which common sliding windows seal, operate, provide for maintenance and lock. Instead of relying on passive seals, the sliding window assemblies of the invention includes compression seals which are compressed and held in compression by movement of the movable sashes caused by the lock mechanisms, during locking. The sash movement during locking includes movement transverse to the plane of the window frame. Instead of simply sliding under manual force to overcome sliding friction, the movable sashes of the invention roll upon sill mounted rollers. Instead of leaving cleaning to homeowner creativity, the sliding window assemblies of the invention include mechanisms for pivoting exterior movable sashes of the assemblies to a maintenance position. In the maintenance position the movable sashes are moved outward away from the interior sashes, exposing the exteriors of the interior sashes to cleaning. Finally, the sliding window assemblies include movable sashes positively locked to the window frames, not other sashes.

In claim terminology, the present invention is, in a principal aspect, a sliding window assembly comprising a frame; a first sash; a second, movable sash; and an elaborate means for mounting the movable sash in the frame. Spatially, the frame defines a plate of the sliding window assembly. Structurally, the first sash is mounted to the frame, and is preferably fixed. The mounting means includes several mechanisms located about the window assembly, and accomplishes at least two functions. The mounting means mounts the movable sash in the frame for (a) horizontal movement of the movable sash in the plane of the window assembly between a closed position and an open position and (b) pivoting movement of the movable sash out of the plane of the window assembly from the open position to a maintenance position.

These aspects, objects and advantages of the invention, now described in summary only, and other aspects, objects and advantages are more fully described in a detailed description of the preferred embodiment of the invention, which follows a brief description of the accompanying drawing.

DETAILED DESCRIPTION OF THE PREFERRED EMBODIMENT

Figure 1:
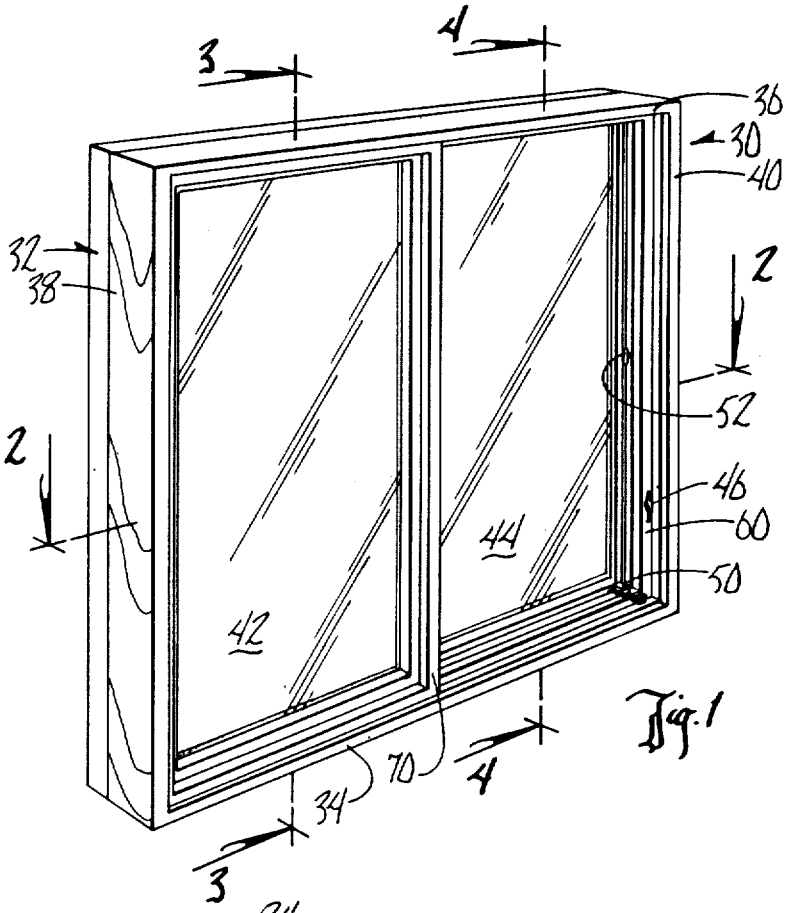
FIG. 1 is a perspective view of the sliding window which is the preferred embodiment of the invention. The view is generally from the window interior.

Referring to FIG. 1, the preferred embodiment of the present invention is a sliding window assembly generally designated 30. Except to the extent features of the window 30 are incorporated in the claims, the following detailed description of window 30 is not intended to restrict the claims. Any and all variations from the preferred embodiment which come within scope and spirit of the claims are intended to be embraced in the claims.

Returning to window 30, a window frame 32 includes a sill 34, a head 36, and two jambs 38, 40. The frame 32 forms a rectangular sash opening into which two sashs 42, 44 are fitted. The interior sash 42 is fixed, and the exterior sash 44 is movable.

Figure 2:
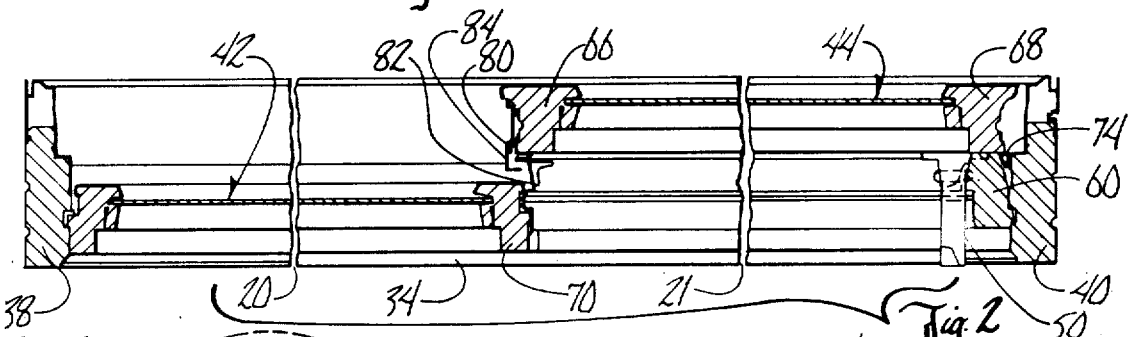
FIG. 2 is a cross-sectional view of the preferred sliding window. The view is cut through the horizontal center of the window, along line 2—2 of FIG. 1. The direction of the view is the direction of the arrow along line 2—2. The view is shortened where the window is uniform, at two break lines 20, 21.
Figure 5:
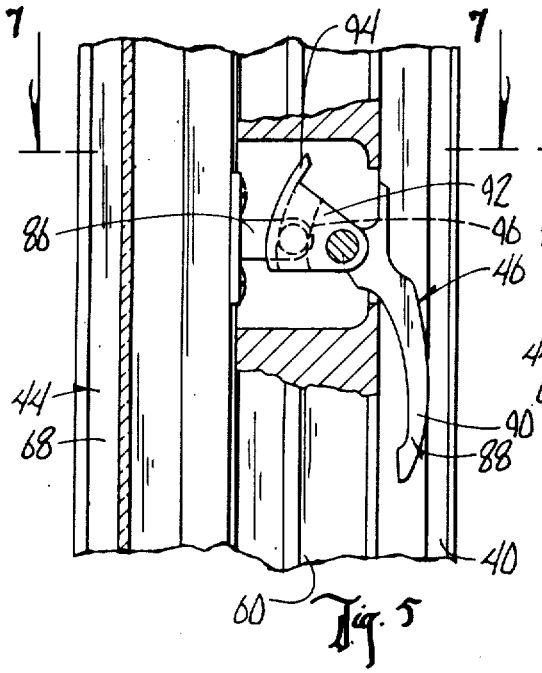
FIG. 5 is a first detail view of the preferred sliding window of the invention. The view reveals a lock mechanism of the window, and a jamb stop of the window is broken away to do so. A lock of the lock mechanism, with handle, is shown in a locking position.
Figure 11:
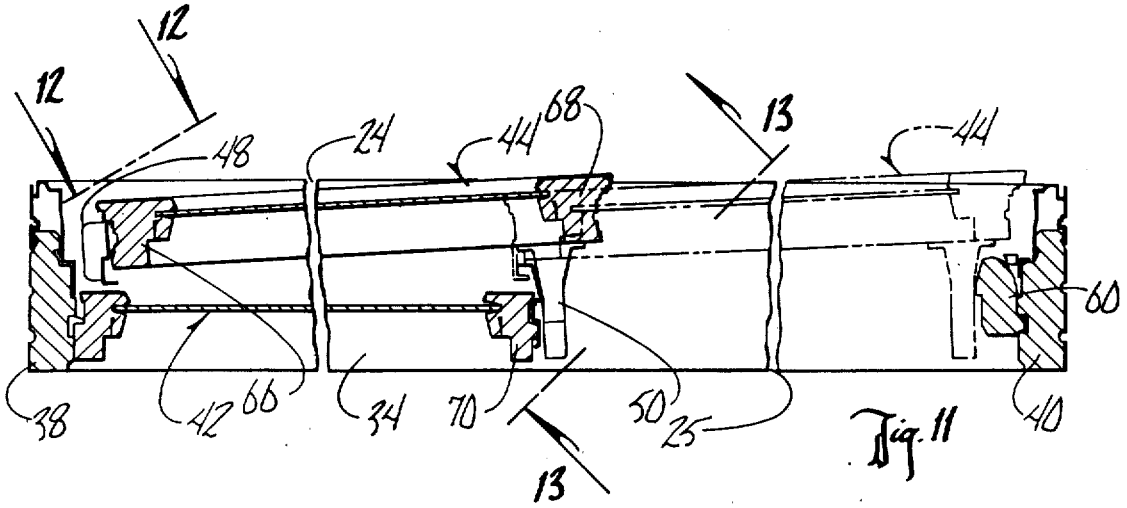
FIG. 11 is a horizontal cross-sectional view similar to FIG. 2, of the preferred window, with the movable sash in a fully opened position. The view is cut through the center of the window, and shortened at break lines 24, 25.

Anticipating description to come of the structures of the window mechanisms, the movable sash 44 is first movable from a closed and locked position as in FIGS. 1 and 2 to a closed and lock released position as in phantom in FIG. 11. This first motion from the closed and locked position occurs under the manual operation of a sash closure lock mechanism, generally 46 in FIG. 5.

The movable sash 44 is next movable along upper and lower tracks to an open position also as in FIG. 11. The sash 44 is manually rolled along the plane of the window on lower trak followers, including rollers of a hinge-roller mechanism, generally 48 in FIG. 12, and a roller-release mechanism, generally 50 in FIG. 9.

Figure 17:
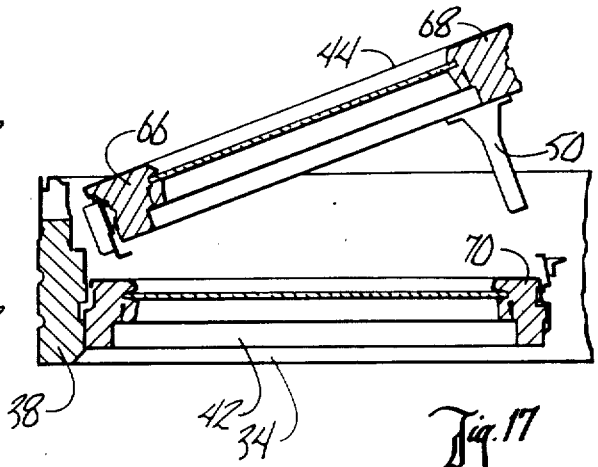
FIG. 17 is a partial cross-sectional view of the preferred window, similar to FIG. 11, showing the movable sash of the window in a maintenance position.
Figure 16:
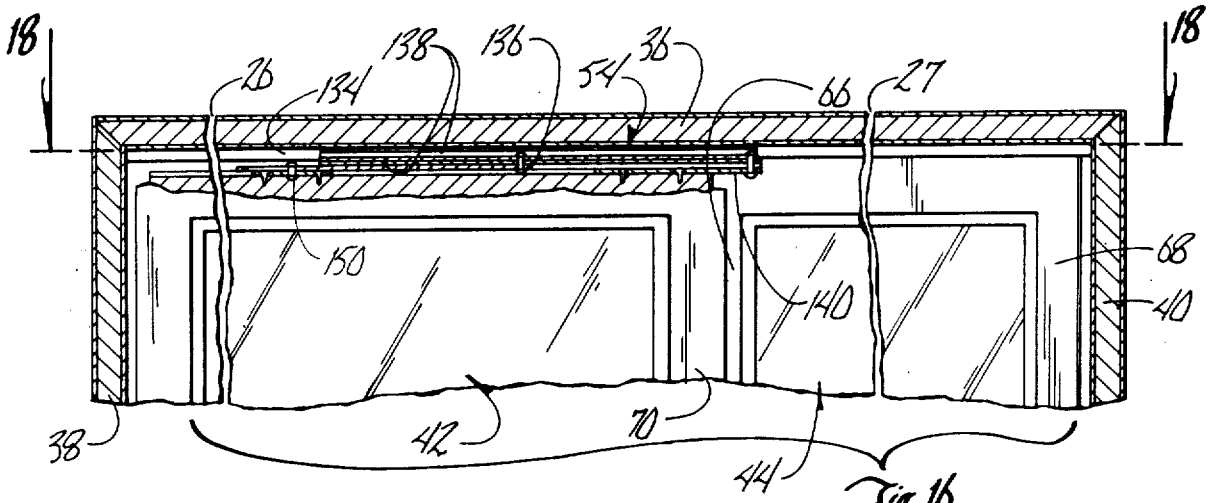
FIG. 16 is a partial cross-sectional view of the top portion of the preferred window assembly taken along line 16—16 in FIG. 15 and broken at lines 26, 27.
Figure 18:
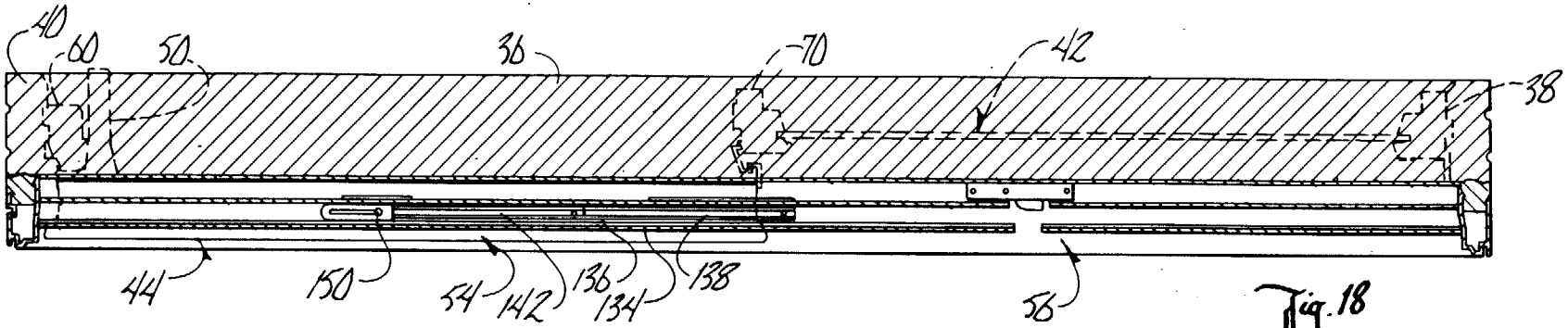
FIG. 18 is a first horizontal cross-sectional view of the top portion of the preferred sliding window. The view is taken along line 18—18 in FIG. 16. The movable sash is closed and locked.
Figure 19:
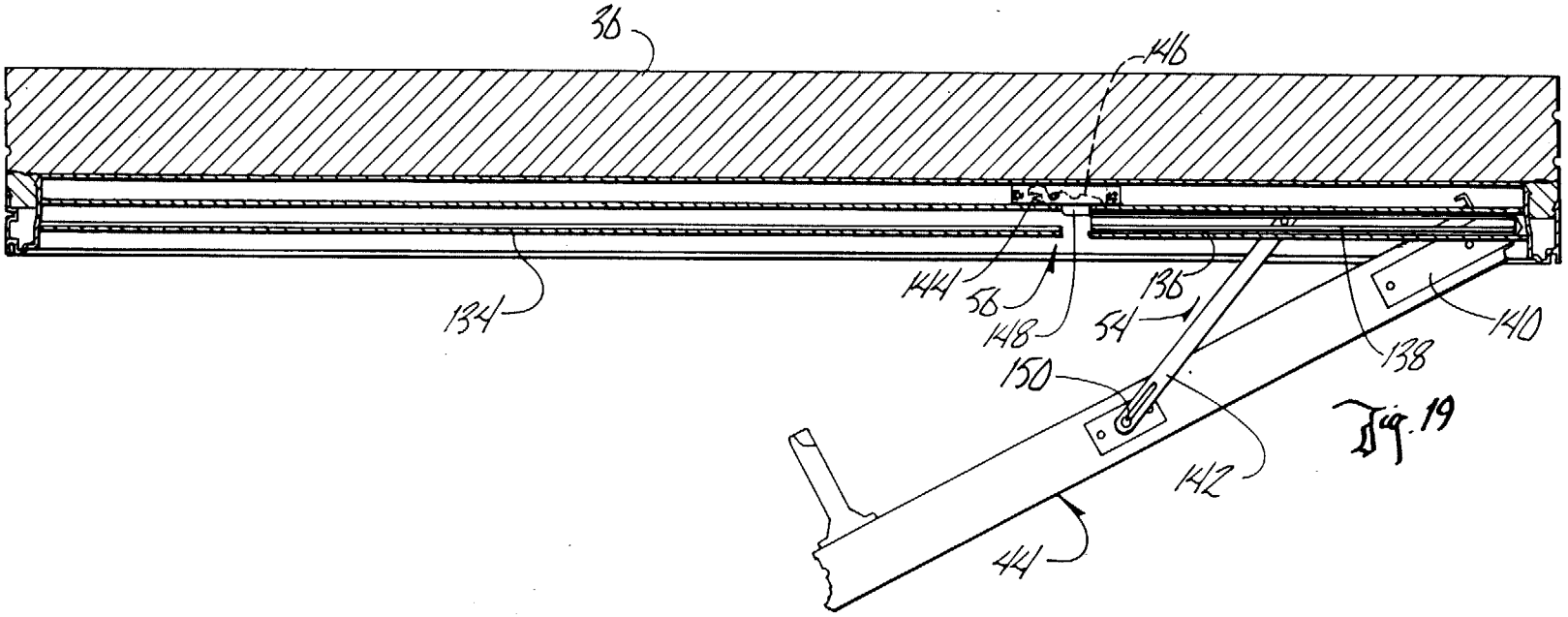
FIG. 19 is a second horizontal cross-sectional view of the top portion of the preferred sliding window. The view is similar to FIG. 18, with the movable sash in the maintenance position of FIG. 17.

From the open position, as desired for cleaning of the fixed sash 42, the movable sash 44 may be pivoted outward from the open position to a maintenance position, as in FIGS. 17 and 19. Pivoting may occur only upon pre-release of an auxiliary lock, generally 52 in FIG. 13. Pivoting is caused manually, by grasping of the sash 44. During pivoting, the sash 44 is supported atop and pivots about the hingeroller mechanism 48, and is supported and pivoted as well by a upper track follower or hinge-slide mechanism, generally 54, located on the head 36, as in FIGS. 16–18. The sash 44 is free to pivot, and the top of sash 44 is locked against sliding. The sash 44 may be locked in the maintenance position by a maintenance lock 56, in FIG. 18. The roller-release mechanism 50 has a handle 109 aiding manual retraction of the sash from the maintenance position. Retraction is caused manually, by grasping of the sash 44 or handle 118.

All the mechanisms 46, 48, 50, 52, 54, 56 constitute one form of a means for mounting the sash 44 to move as described. The mechanisms 48, 50 alone and in combination with mechanism 54 also constitute one form of a mounting means as described in the summary of the invention.

Figure 3:
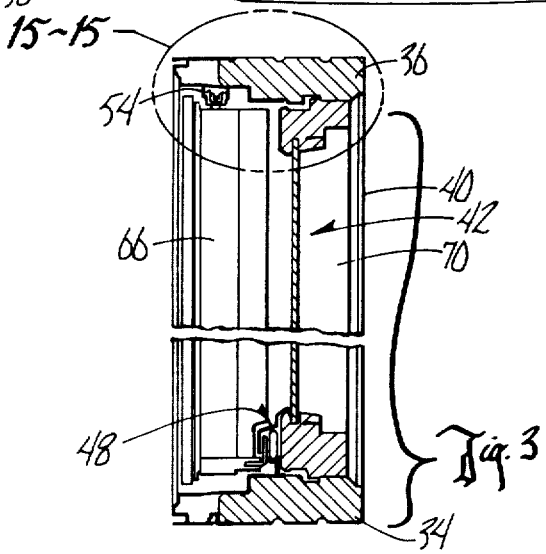
FIG. 3 is a vertical cross-sectional view through a fixed sash of the preferred sliding window along line 3—3 of FIG. 1. The direction of the view is the direction of the arrows along line 3—3, and the view is shortened at break line 22.
Figure 4:
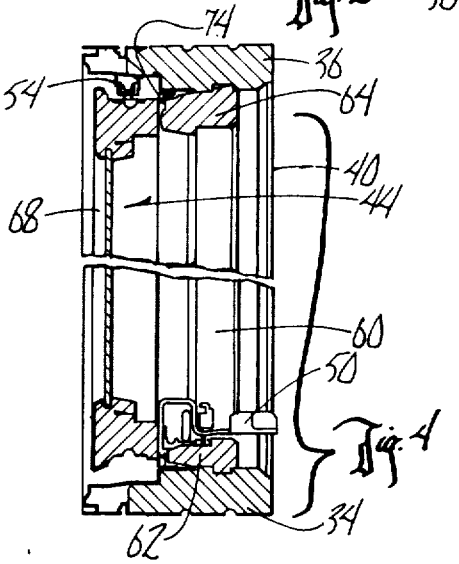
FIG. 4 is a vertical cross-sectional view through a movable sash of the preferred sliding window along line 4—4 of FIG. 1. The direction of the view is the direction of the arrows along line 4—4, and the view is shortened at break line 23.

Referring to FIGS. 2–4, the frame head 36 includes a wood head member with an exposed interior surface. An aluminum extrusion is snap-fit into grooves on the wood member. The extrusion provides desirable aluminum clad exterior to the head. Each jamb 38, 40 includes a wood jamb member, also with an exposed wood interior surface and an aluminum clad exterior. The sill 34 is similarly clad.

The jamb 40, remote from the fixed sash 42, includes a wood jamb stop 60. The jamb stop 60 is fastened to the jamb member 40. The sill 34 siimlarly includes a sill stop 62 and the head 36 includes a head stop 64. The three stops 60, 62, 64 provides surfaces against which the movable sash 44 is locked.

Each sash 42, 44 includes a central pane of glazing or glass surrounded by aluminum-clad wood sash members. The sash members include a pair of upright stiles and a pair of horizontal rails. The movable sash stiles are a hinge side stile 66 and a swing or lock side stile 68. The fixed sash stiles include a central stile 70.

Figure 15:
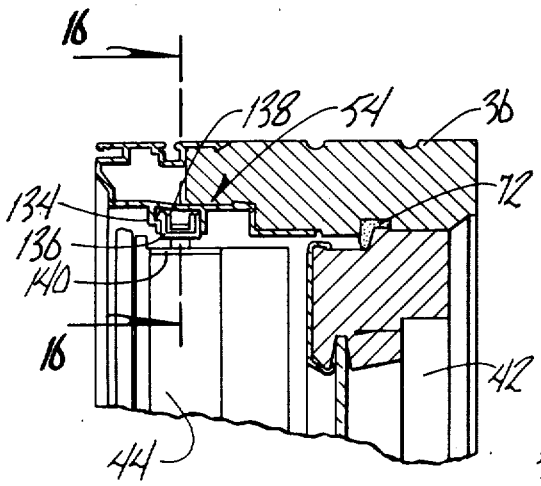
FIG. 15 is a vertical cross-sectional view of a portion of the preferred sliding window, taken in the area circled 15 in FIG. 3.

The fixed sash 42 is fixed to the frame 32. As shown best in FIG. 15, caulking 72 between a corner of the fixed sash members, other than the central stile 70, and a groove in the adjacent frame members, forms a highly effective seal about the fixed sash. The caulking is between the sash members and frame members in both the plane of the window and also transverse to the window.

A highly effective seal is also provided around the movable sash, when closed and locked. As shown in FIGS. 2, 4, 7, 8 and 11 (shown best in FIG. 7), a compression seal 74 extends along the sill, jamb and head stops 60, 62, 64. A barb 76 of the seal 74 engages a groove in the stops, and holds a compressable bulb 78 of the seal against an exterior surface of the stops. Movement of the movable sash 44 into the closed, locked position compresses the bulb 78, creating the effective seal between the stops and all three of the movable sash head rail, sill rail and swing side stile.

A leaf seal 80, shown in FIG. 2, completes the movable sash seal. The leaf seal 80 is on the interior surface of the hinge side stile 66, and wipes an elongated protrusion 82 of the fixed sash central stile 70. An overlying extruded flange 84 on the side of the hinge side stile 66 shelters the leaf seal 80 from direct exposure to weather.

Referring now to FIGS. 5–9, the sash closure lock mechanism 46 constitutes one form of a means for locking the movable sash to the frame in the closed position of the sash. The mechanism 46 moves the sash between a closed, locked position and a closed, lock released position. A keeper 86 of the mechanism 46 is fastened to the lower central portion of the movable sash lock side stile 68. The keeper projects from a fastened keeper base along a keeper projection to a keeper roller.

Figure 6:
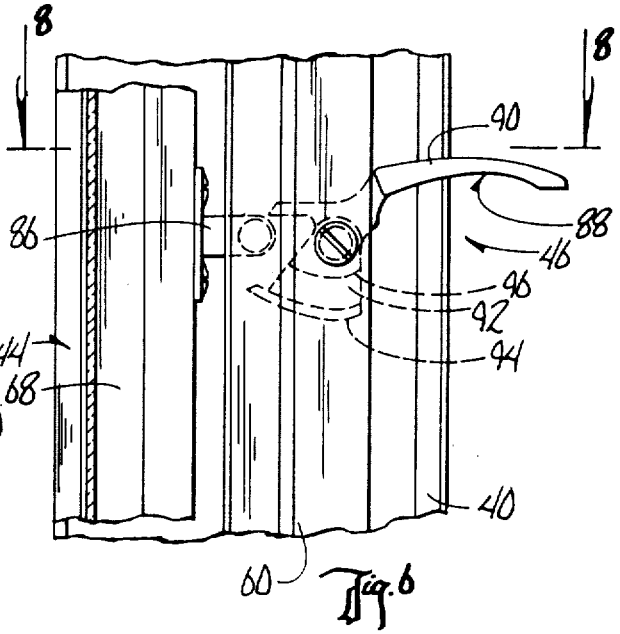
FIG. 6, a view similar to FIG. 5, is a second detail view of a portion of the preferred sliding window of the invention. The view reveals the lock mechanism of the window, in a lock released position.
Figure 7:
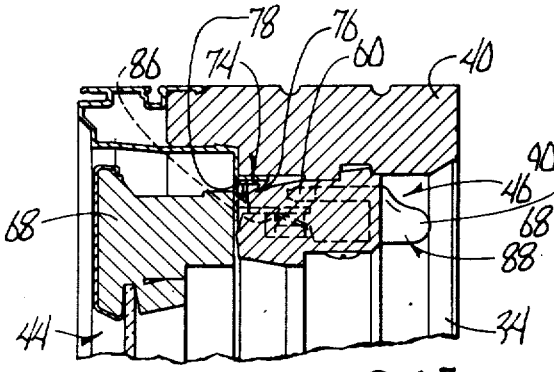
FIG. 7 is a first cross-sectional view of a portion of the preferred sliding window in the area of the lock mechanism shown in FIGS. 5 and 6. The view is horizontal along the line 7—7 in FIG. 5, and in the direction of the arrows along line 7—7.
Figure 8:
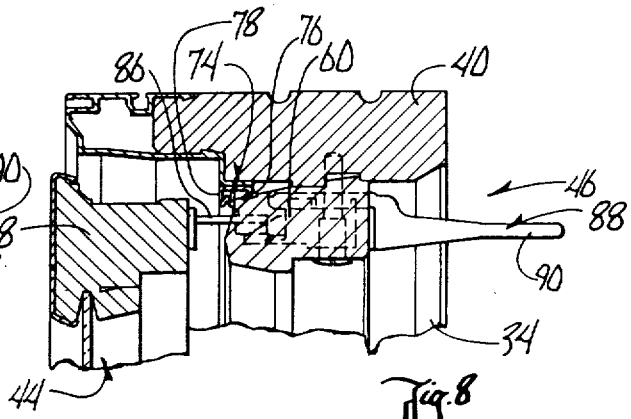
FIG. 8 is a second cross-sectional view of a portion of the preferred sliding window in the area of the lock mechanism shown in FIGS. 5 and 6. The view is horizontal, along the line 8—8 in FIG. 6, and in the direction of the arrows along line 8—8.

A manually operated lock member 88 includes a handle 90, and is pivotally mounted to the jamb stop 60 within a cavity therein. A camming member 92 of the member 88 projects from the pivot mounting opposite the handle 90. With the sash 44 in the closed, lock released position, the keeper 86 is adjacent the lock member 92. Referring to FIG. 6, the keeper 86 is in position to be captured by the cam member 92.

Rotation of the handle 90 downward causes the cam member 92 to capture and captivate the keeper roller on both sides in a curved groove between an outer camming surface 94 and an opposed, inner camming surface 96. The keeper tracks the camming surfaces, and these surfaces are contoured to pull the keeper into the plane of the window toward the jamb stop 60, and simultaneously along the plane of the window also toward the jamb stop. With extreme movement of the handle, to the position of FIGS. 5 and 7, the lock member 88 pulls the sash 44 by the keeper 86 into sealing engagement with the compression seal 74.

Raising the handle 90, because of the inner cam surface 96, positively drives (as opposed to passively permits) the keeper 86 and thereby the sash 44 to the closed, lock released condition.

The sash swing side is supported during movement caused by the sash lock mechanism 46 by the roller-release mechanism 50. The mechanism 50 also supports the swing side during movement of the movable sash to the open position. During movement to the maintenance position, the mechanism 50 provides no support.

Figure 9:
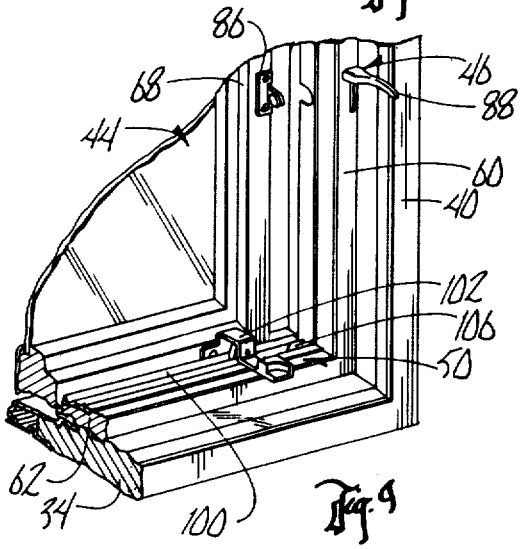
FIG. 9 is a partial perspective view of a portion of the preferred sliding window of the invention, similar in its part to FIG. 1, on a larger scale. The view focuses upon a roller-handle assembly of the preferred window. The movable sash of the window is in a lock released position.
Figure 10:
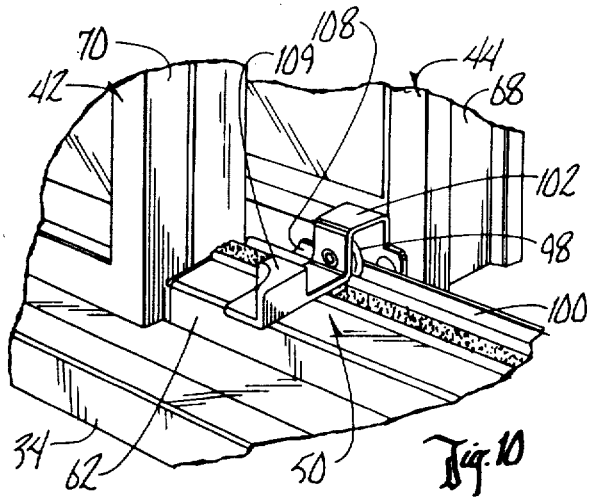
FIG. 10 is partial window view of a portion of the preferred sliding window of the invention. The view focuses upon the roller-handle assembly of the preferred window, as does FIG. 9. The movable sash of the window is in a fully opened position.

Referring to FIGS. 9 and 10, a roller 98 of the mechanism 50 rests in a track 100 along the sill. The track is in the sill extrusion, and extends between the fixed sash central stile 70 and the remote jamb 40. With the fixed sash 42 in place, the window 30 defines a window opening adjacent the sash 42, and the sill defines a sill opening portion along the window opening. The roller track 100 is along the sill opening portion.

The roller 98 is mounted on a track 102. The roller supports the truck, and is mounted to the truck for rolling movement along the track 100, about an axis transverse to the plane of the window 30. The track is fastened to the bottom corner of the swing side stile 68.

Adjacent the jamb stop 60, the interior flange of the rail 100 has a notch 106. A roller releasing gap is defined by the notch 106. This gap provides for sliding movement of the roller 98 out of the track 100 during movement of the sash 44 to and form the closed, locked position.

The opposite end of the track 100 is also notched. Adjacent the central stile 70, the exterior flange of the track 100 has a notch 108. The roller releasing gap defined by this notch provides for movement of the roller 98 out of the track 100 during movement of the dash 44 to and from the maintenance position. The user normally grasps the sash 44 to cause such movement. An interiorly extending handle 109 of the truck 102 may be grasped to facilitate the movement of the sash 44 to the open position, and return of the roller 98 to the track 100.

Figure 12:
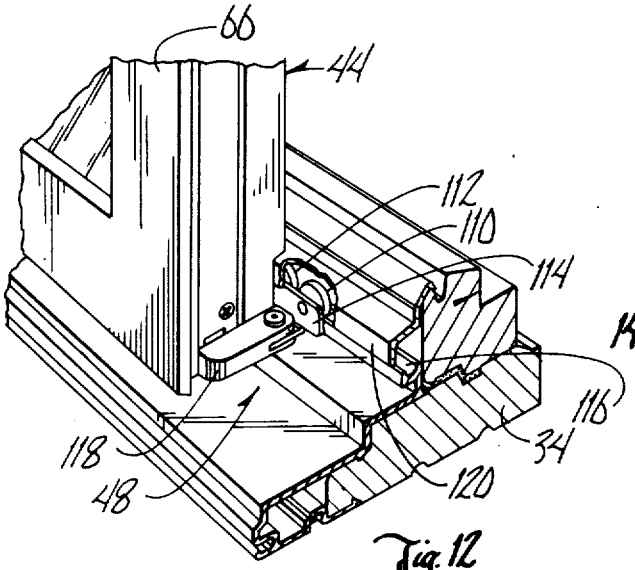
FIG. 12 is a partial perspective view of a portion of the preferred sliding window, similar in perspective to FIG. 10, focusing on a hinge-roller assembly of the preferred window. The view is taken along line 12—12 of FIG. 11.

As stated, the sash swing side is supported by the mechanism 50. The opposite, sash hinge side is supported in part by the mechanism 48. Like the mechanism 50, the mechanism 48 includes at least one roller in a track, on a truck. Referring to FIG. 12, a pair of rollers 110, 112 are rollably mounted on a track 114. The rollers are in a track 116.

Unlike the mechanism 50, the truck 114 of the mechanism 48 is not directly fastened to the movable sash 44. Instead, a sash arm 118 is fastened to the lower corner of the sash hinge stile 66. The truck 114 is pivotally fastened to the arm 118.

The track 116 is uninterrupted, without notches. The rollers 110, 112 remain at all operative times in the track 116, which is located along the exterior of the fixed sash 42 atop the sill 34. A weather cap 120 over the track 116 and rollers 110, 112 protect these elements from weather.

The movable sash 44 is pivotable about the roller truck 114. During swinging movement of the sash 44 to and from the maintenance position, the sash arm 118 pivots with the sash 44 about the pivotal connection between the arm 118 and truck 114.

Figure 13:
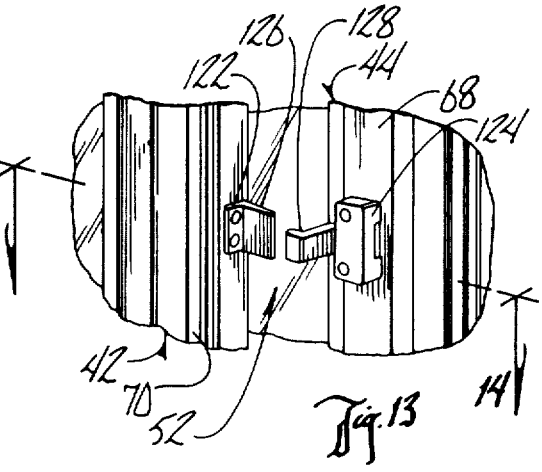
FIG. 13 is a partial perspective view of a portion of the preferred sliding window taken along line 13—13 in FIG. 11. The view focuses on an auxiliary lock mechanism of the preferred sliding window.
Figure 14:
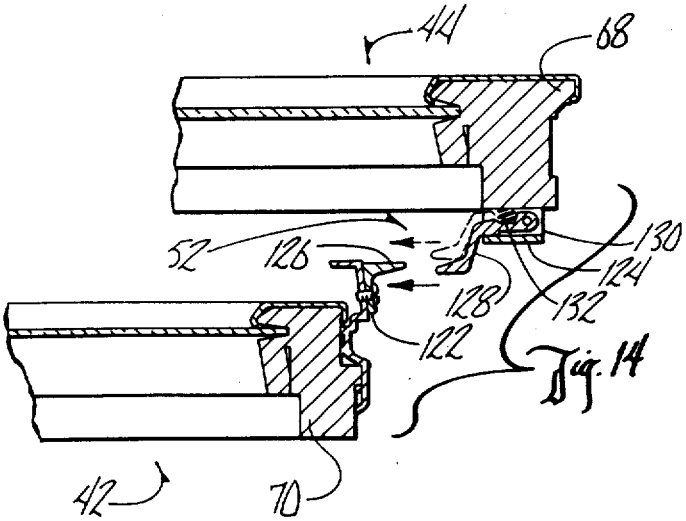
FIG. 14 is a horizontal cross-sectional view of the auxiliary lock mechanism shown in perspective in FIG. 13.

Referring to FIGS. 13–14, the auxiliary lock 52 must be released for such swinging motion to occur. A first auxiliary lock member 122 is fastened on the central stile 70. A blade 126 of the member 122 projects at an angle toward the exterior of the fixed sash into the adjacent window opening.

A second auxiliary lock member 124 is fastened on the swing stile 68. A cooperating blade 128 of the member 124 is pivotally mounted to a base 130 and spring biased to a position of potential hooking of the two blades. If left unmoved, the cooperating blade 128 hooks the blade 126 as the sash 44 moves to the open position. If manually moved against the bias of the spring 132, as in FIG. 14, the blade 128 moves past the exterior of the blade 126, unhooked. The sash 44 may then be swung to the maintenance position.

Turning to FIGS. 15–19, the hinge slide mechanism 54 completes the window assembly 30. A slider channel 134 extends along the head 36, to the exterior of the fixed sash 42. A slider 136 of plastic or the like is slidably mounted in the channel 134. A U-channel 138 is inserted and fastened in the slider 136, and is pivotally attached to an upper sash arm 140. The sash arm 140 is fastened to the sash 44.

As the sash 44 rolls along the window 30, the slider 136 and U-channel 138 move along the channel 134, pulled and pushed by the sash arm 140. As the sash 44 swings, the slider 136 and channel 138 remain stationary. The dash 44 and arm 140 pivot about the connection of the arm 140 and U-channel 138. A limit arm 142 pivotally mounted to the hinge-slide and sash 44 limits the amount of outward pivoting of the sash 44, and thereby defines the maintenance position.

The maintenance lock 56 is available to lock the sash 44 in the maintenance position. A spring 144 biases a pivotable member 146 to cause a tab 148 to project into the channel 134. The tab cams back into a recess as the slider 136 moves by, during movement to the maintenance position. The tab returns to the channel 134 after the slider has passed to block reverse movement of the slider. A pin 150 on the sash 44 automatically depresses the tab when the sash is pivoted back to the fully open position.

The preferred embodiment of the invention is now described. This preferred embodiment constitutes the best mode contemplated by the interior of carrying out the invention. The invention, and the manner and process of making and using it, have been described in full, clear, concise and exact terms to enable any person skilled in the art to make and use the same. Because the invention may be copied without the copying the precise details of the preferred embodiment, the following claims particularly point out and distinctly claim the subject matter which the inventor regards as his invention and wishes to protect.

What is claimed is:

1. A window assembly in a window frame, said frame including a head, a sill, and opposite jambs, said assembly comprising: first and second sashes each having interior and exterior surfaces, a top, a bottom, and opposite first and second sides extending between said top and said bottom;

said first sash being laterally movable within said window frame between a closed position and an open position wherein said first sash is substantially in a non-planar position relative to said second sash;

track means extending along one of said sill or head of said window frame;

first track follower means connected to one of said top or said bottom of said first sash adjacent said first side thereof and cooperating with said track means for supporting and guiding said first sash during lateral movement between said open and closed positions; and said track means having an opening therein for releasing said track follower means for cooperation therewith only when said first sash is in said open position such that said first sash is pivotal about a vertical axis adjacent said second side thereof between said open position and a maintenance position.

2. The window assembly of claim 1 wherein said first track follower means includes a roller truck mounted on said first sash adjacent said first end thereof, and at least one roller rotatably mounted on said roller truck and rollably received in said lower track means.

3. The window assembly of claim 1 further comprising second track follower means pivotally connected to said one of said top or said bottom of said first sash adjacent said second side thereof and cooperating with said track means for supporting and guiding said first sash during lateral movement between said closed and open positions and for pivotally supporting said first sash during pivotal movement between said open and maintenance positions.

4. The window assembly of claim 2 wherein said second track follower means includes a sash arm mounted on said first sash adjacent said second side thereof, a roller truck pivotally connected to said sash arm, and at least one roller rotatably mounted on said roller truck and rollably received in said track means.

5. The window assembly of claim 1 further comprising auxiliary track means extending along the other one of said sill or said head of said window frame and auxiliary track follower means pivotally connected to said bottom or said top of said first sash adjacent said second side thereof and cooperating with said auxiliary track means for guiding said first sash during lateral movement thereof between said closed and open positions and for pivotally supporting said first sash during pivotal movement thereof between said open and maintenance positions.

6. The window assembly of claim 5 wherein said auxiliary track follower means includes an elongated slide member pivotally connected to said first sash and slidably received in said upper track means.

7. The window assembly of claim 5 further comprising maintenance lock means for locking said first sash in said maintenance position.

8. The window assembly of claim 7 wherein said maintenance lock means includes a lock member mounted on the other one of said sill or said head of said window frame and retractably extending into said auxiliary track means, said lock member being depressed by said auxiliary track follower means during movement of said first sash between said closed and open positions, and said lock member releasably engaging said auxiliary track follower means to prevent movement thereof, and thus prevent movement of said first sash, when said first sash is in said maintenance position.

9. The window assembly of claim 8 wherein said maintenance lock means further includes spring means for normally biasing said lock member into position in said auxiliary track means.

10. The window assembly of claim 8 further comprising means on said first sash for depressing said lock member when said first sash is moved from said maintenance position to said open position.

11. The window assembly of claim 1 further comprising closure lock means for locking said first sash in said closed position.

12. The window assembly of claim 11 wherein said closure lock means includes a keeper on said first sash adjacent said first side thereof, and a handle pivotally mounted on one of said jambs of said window frame, said handle having a first cam surface for capturing and pulling said keeper to a locked position and a second cam surface for pushing and releasing said keeper from said locked position.

13. The window assembly of claim 1 further comprising an auxiliary lock means for preventing said first sash from pivoting from said position to said maintenance position.

14. The window assembly of claim 13 wherein said auxiliary lock means includes a first projection member attached to said first sash adjacent said first side thereof and extending interiorally therefrom, and a second projection member attached to said second sash adjacent said first side thereof and extending exteriorly therefrom, said first and second projection members releasably overlapping one another when said first sash is in said open position to prevent said first sash from pivoting to said mainenance position.

15. The window assembly of claim 14 wherein said auxiliary lock means further includes spring means for normally biasing said first projection member into overlapping engagement with said second projection means when said first sash is in said open position.

16. A window assembly in a window frame, said frame including a head, a sill, and opposite jambs, said assembly comprising:

first and second sashes each having interior and exterior surfaces, a top, a bottom, and opposite first and second sides extending between said top and said bottom;

said first sash being laterally movable within said window frame between a closed position wherein said first sash is in a non-planar side-by-side relation with said second sash and an open position wherein said first sash is substantially in front of said second sash;

upper track means extending along said head of said window frame;

an elongated slide member pivotally connected at one end to said first sash and being slidably received in said upper track means;

said slide member guiding said first sash during lateral movement thereof between said closed and open positions; and a lower track means extending along said sill of said window frame, and first lower track follower means connected to said bottom of said first sash adjacent said first side thereof and cooperating with said lower track means for supporting and guiding said first sash during lateral movement thereof between said closed and open positions, and said lower track means having an opening therein for releasing said first lower track follower means from cooperation therewith only when said first sash is in said open position such that said first sash is pivotal about a vertical axis adjacent said second side thereof between said open position and a maintenance position.

17. The window assembly of claim 16 further comprising maintenance lock means for locking said first sash in said maintenance position.

18. The window assembly of claim 17 wherein said maintenance lock means includes a lock member mounted on said head of said window frame and retractably extending into said upper track means, said lock member being depressed by said slide member during movement of said first sash between said closed and open positions, and said lock member releasably engaging said slide member to prevent movement thereof, and thus prevent movement of said first sash, when said first sash is in said maintenance position.

19. The window assembly of claim 18 wherein said maintenance lock means further includes spring means for normally biasing said lock member into position in said upper track means.

20. The window assembly of claim 18 further comprising means on said first sash for depressing said lock member when said first sash is moved from said maintenance position to an open position.

21. The window assembly of claim 16 wherein said first track follower means includes a roller truck mounted on said first sash adjacent said first end thereof, and at least one roller rotatably mounted on said roller truck and rollably received in said lower track means.

22. The window assembly of claim 16 further comprising second lower track follower means pivotally connected to said bottom of said first sash adjacent said second side thereof and cooperating with said lower track means for supporting and guiding said first sash during lateral movement between said closed and open positions and for pivotally supporting said first sash during pivotal movement between said open and maintenance positions.

23. The window assembly of claim 22 wherein said second lower track follower means includes a lower sash arm mounted on said first sash adjacent said second side thereof, a roller truck pivotally connected to said sash arm, and at least one roller rotatably mounted on said roller truck and rollably received in said lower track means.

24. A window assembly in a window frame, said frame including a head, a sill, and opposite jambs, said assembly comprising:

first and second sashes each having interior and exterior surfaces, a top, a bottom, and opposite first and second sides extending between said top and said bottom;

said first sash being laterally movable within said window frame between a closed position wherein said first sash is in a non-planar side-by-side relation with said second sash and an open position wherein said first sash is substantially in front of said second sash, and being pivotal about a vertical axis adjacent said second side thereof between said open position and a maintenance position;

upper track means extending along said head of said window frame;

an elongated slide member pivotally connected at one end to said first sash and being slidably received in said upper track means;

said slide member guiding said first sash during lateral movement thereof between said closed and open positions; and an auxiliary lock means for preventing said first sash from pivoting from said open position to said maintenance position.

25. The window assembly of claim 24 wherein said auxiliary lock means includes a first projection member attached to said first sash adjacent said first side thereof and extending interiorly therefrom, and a second projection member attached to said second sash adjacent said first side thereof and extending exteriorly therefrom, said first and second projection members releasably overlapping one another when said first sash is in said open position to prevent said first sash from pivoting to said maintenance position.

26. The window assembly of claim 12 wherein said auxiliary lock means further includes spring means for normally biasing said first projection member into overlapping engagement with said second projection member when said first sash is in said open position.

27. A window assembly in a window frame, said frame including a head, a sill, and opposite jambs, said assembly comprising:

first and second sashes each having interior and exterior surfaces, a top, a bottom, and opposite first and second sides extending between said top and said bottom;

said first sash being laterally movable within said window frame between a closed position and an open position wherein said first sash is in a side by side position relative to said second sash and is in a plane parallel to the plane of said second sash;

track means extending along one of said sill or head of said window frame;

first track follower means connected to said first sash adjacent said first side thereof and cooperating with said track means for supporting and guiding said first sash during lateral movement between said open and closed positions; and said track means having an opening therein for releasing said first track follower means from cooperation therewith only when said first sash is in said open position such that said first sash is pivotal about a vertical axis adjacent said second side thereof between said open position and a maintenance position wherein said first sash is pivoted away from said second sash.

28. The window assembly of claim 27 wherein said first track follower means includes a roller truck mounted on said first sash adjacent said first side thereof, and at least one roller rotatably mounted on said roller truck and rollably received in said track means.

29. The window assembly of claim 27 further comprising second track follower means pivotally connected to said first sash adjacent said second side thereof and cooperating with said track means for supporting and guiding said first sash during lateral movement between said closed and open positions and for pivotally supporting said first sash during pivotal movement between said open and maintenance positions.

30. The window assembly of claim 29 wherein said second track follower means includes a sash arm mounted on said first sash adjacent said second side thereof, a roller truck pivotally connected to said sash arm, and at least one roller rotatably mounted on said roller truck and rollably received in said track means.

31. The window assembly of claim 27 further comprising second track means extending along the other of said head or sill of said window frame and third track follower means pivotally connected to said first sash adjacent said second side thereof and cooperating with said second track means for guiding said first sash during lateral movement thereof between said closed and open positions and for pivotally supporting said first sash during pivotal movement thereof between said open and maintenance positions.

32. The window assembly of claim 31 wherein said third track follower means includes an elongated slide member pivotally connected to said first sash and slidably received in said second track means.

33. The window assembly of claim 31 further comprising maintenance lock means for locking said first sash in said maintenance position.

34. The window assembly of claim 33 wherein said maintenance lock means includes a lock member mounted on said window frame and retractably extending into said second track means, said lock member being depressed by said third track follower means during movement of said first sash from said closed position to said open position, and said lock member releasably engaging said third track follower means to prevent movement thereof towards said closed position, and thus prevent movement of said first sash towards said closed position, when said first sash is in said maintenance position.

35. The window assembly of claim 34 wherein said maintenance lock means further includes spring means for normally biasing said lock member into position in said second track means.

36. The window assembly of claim 34 further comprising means on said first sash for depressing said lock member when said first sash is moved from said maintenance position to said open position thereby allowing said first sash to move to said closed position.

37. The window assembly of claim 27 further comprising closure lock means for locking said first sash in said closed position.

38. The window assembly of claim 36 wherein said closure lock means includes a keeper on said first sash adjacent said first side thereof, and a handle pivotally mounted on one of said jambs of said window frame, said handle having a first cam surface for capturing and pulling said keeper to a locked position and a second cam surface for pushing and releasing said keeper from said locked position.

39. The window assembly of claim 27 further comprising an auxiliary lock means for releasably preventing said first sash from pivoting from said open position to said maintenance position.

40. The window assembly of claim 39 wherein said auxiliary lock means includes a first projection member attached to said first sash adjacent said first side thereof and extending interiorally therefrom, and a second projection member attached to said second sash adjacent said first side thereof and extending exteriorly therefrom said first and second projection members releasably overlapping one another when said first sash is in said open position to prevent said first sash from pivoting to said maintenance position.

41. The window assembly of claim 40 wherein said auxiliary lock means further includes spring means for normally biasing said first projection member into overlapping engagement with said second projection means when said first sash is in said open position.

* * * * *

UNITED STATES PATENT AND TRADEMARK OFFICE

CERTIFICATE OF CORRECTION

PATENT NO. : 4,682,455

DATED : July 28, 1987

INVENTOR(S) : Marlo Van Klompenburg

It is certified that error appears in the above-identified patent and that said Letters Patent is hereby corrected as shown below:

On the title page, Item [19] "Klompenburg" should read -- Van Klompenburg --.

Item [75] "Marlo V. Klompenburg" should read

-- Marlo Van Klompenburg --.

Signed and Sealed this

Twenty-first Day of June, 1988

*Attest:*

*Attesting Officer*

DONALD J. QUIGG

*Commissioner of Patents and Trademarks*